US010743672B2

(12) United States Patent
Iles et al.

(10) Patent No.: US 10,743,672 B2
(45) **Date of Patent: *Aug. 18, 2020**

(54) BUOYANT POOL LOUNGE CHAIR

(71) Applicant: TRC Recreation, LP, Wichita Falls, TX (US)

(72) Inventors: Matthew J. Iles, Graham, TX (US); Christopher B. Holland, Graham, TX (US); Michael V. Nelson, Wichita Falls, TX (US)

(73) Assignee: TRC Recreation, LP, Wichita Falls, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/541,802

(22) Filed: Aug. 15, 2019

(65) Prior Publication Data

US 2019/0365109 A1 Dec. 5, 2019

Related U.S. Application Data

(63) Continuation of application No. 16/138,615, filed on Sep. 21, 2018, now Pat. No. 10,383,450.

(60) Provisional application No. 62/568,613, filed on Oct. 5, 2017.

(51) Int. Cl.

| | |
|---|---|
| ***B63B 35/74*** | (2006.01) |
| ***A47C 15/00*** | (2006.01) |
| ***A47C 1/14*** | (2006.01) |
| ***A47C 4/02*** | (2006.01) |
| ***A47C 7/42*** | (2006.01) |
| ***A47C 1/027*** | (2006.01) |
| ***A47C 7/50*** | (2006.01) |
| ***A47C 7/62*** | (2006.01) |
| ***B63B 34/50*** | (2020.01) |

(52) U.S. Cl.

CPC ..... *A47C 15/006* (2013.01); *A47C 1/027* (2013.01); *A47C 1/143* (2013.01); *A47C 1/146* (2013.01); *A47C 4/02* (2013.01); *A47C 7/42* (2013.01); *A47C 7/5066* (2018.08); *A47C 7/624* (2018.08); *B63B 34/50* (2020.02)

(58) Field of Classification Search

CPC ..... B63B 35/74; A47C 15/006

See application file for complete search history.

(56) References Cited

U.S. PATENT DOCUMENTS

| | | | |
|---|---|---|---|
| 3,074,759 | A | 1/1963 | Bergenwall |
| 3,154,345 | A | 10/1964 | Lambrecht |
| 3,620,570 | A | 11/1971 | Wilson |
| 3,984,888 | A | 10/1976 | DeLano |

(Continued)

*Primary Examiner* — Stephen P Avila

(74) *Attorney, Agent, or Firm* — Scott T. Griggs; Griggs Bergen LLP

(57) ABSTRACT

A buoyant pool lounge chair is disclosed. In one embodiment of the buoyant pool lounge chair, frame members collectively form an open chair frame with buoyant cushions forming a chair seat and a backrest as well as a left arm rest and a right arm rest. The left arm rest and the right arm rest are each intersected by a cup holder. A recess in the cup holder has a forward tilt relative to a horizontal axis having an angle between approximately 20 degrees and approximately 40 degrees toward the front end of the buoyant pool lounge chair. In operation, when the buoyant pool lounge chair is supporting a person while the buoyant pool chair is floating in water, the forward tilt of the cup holder provides a compensating-leveling mechanism that mitigates spilling of liquid in the cup when the cup is placed within the cup holder.

20 Claims, 4 Drawing Sheets

(56) References Cited

U.S. PATENT DOCUMENTS

| | | | |
|---|---|---|---|
| 4,026,567 | A | 5/1977 | Rye |
| 4,358,866 | A | 11/1982 | Rhodes |
| 4,384,857 | A | 5/1983 | Hoy, Jr. |
| 4,435,165 | A | 3/1984 | Johnson |
| 4,484,781 | A | 11/1984 | Phelps |
| 4,662,852 | A | 5/1987 | Schneider et al. |
| 4,884,840 | A | 12/1989 | Linden et al. |
| 5,004,296 | A | 4/1991 | Ziegenfuss, Jr. |
| 5,052,965 | A | 10/1991 | Klapp et al. |
| 5,088,723 | A | 2/1992 | Simmons |
| 5,226,184 | A | 7/1993 | Cheng |
| 5,307,527 | A | 5/1994 | Schober |
| 5,320,406 | A | 6/1994 | North |
| 5,403,220 | A | 4/1995 | Goad, Sr. |
| 5,439,405 | A | 8/1995 | Storey et al. |
| 6,045,423 | A | 4/2000 | Silva |
| 6,059,360 | A | 5/2000 | Bedard |
| 6,086,150 | A | 7/2000 | Scheurer et al. |
| 6,312,054 | B1 | 11/2001 | Scheurer et al. |
| 6,520,576 | B1 | 2/2003 | Burns |
| 6,527,343 | B2 | 3/2003 | Scheurer et al. |
| 6,783,181 | B2 | 8/2004 | Scheurer et al. |
| 7,182,401 | B2 | 2/2007 | Scheurer et al. |
| 10,383,450 | B2 | 8/2019 | Iles et al. |
| 2004/0232753 | A1 | 11/2004 | Scheurer et al. |
| 2006/0061180 | A1 | 3/2006 | Scheurer et al. |
| 2006/0138814 | A1 | 6/2006 | Burbrink |

BUOYANT POOL LOUNGE CHAIR

PRIORITY STATEMENT & CROSS-REFERENCE TO RELATED APPLICATIONS

This application is a continuation of U.S. patent application Ser. No. 16/138,615 entitled "Buoyant Pool Lounge Chair" filed on Sep. 21, 2018, in the names of Matthew J. Iles et al., now U.S. Pat. No. 10,383,450, issued on Aug. 20, 2019; which claims priority from U.S. patent application Ser. No. 62/568,613 entitled "Buoyant Pool Lounge Chair" filed on Oct. 5, 2017, in the names of Matthew J. Iles et al.; all of which are hereby incorporated by reference for all purposes.

TECHNICAL FIELD OF THE INVENTION

This invention relates, in general, to swimming pool accessories, and, in particular, to a buoyant pool lounge chair for supporting a person in a seated position while the buoyant pool lounge chair is floating in water.

BACKGROUND OF THE INVENTION

Swimming pools offer personal recreation and relaxation in a variety of settings, including private homes, apartment complexes, motels, resorts, and country clubs. Various flotation devices including buoyant chairs, rafts, water wings, floating cushions, body floats and air mattresses are used by swimmers as an aid for floating and relaxing on the surface of the water, while remaining seated upright, reclining or lounging, either partially or completely submerged. These items of pool furniture include flotation cushions made of a buoyant material such as open cell foam, closed cell foam, cork, kapok, fiberglass or balsa wood, which are sealed within a protective outer covering. Special care should be taken in the construction of buoyant lounge chairs to provide comfort while maintaining a sufficient buoyancy material to furnish a comfortable and stable upright orientation during use. The buoyant lounge chair may overturn in response to shifting of its center of buoyancy as the occupant turns or moves about and, as a result, there is a continuing need for improved design that also meets expectations of ever increasing comfort and convenience.

SUMMARY OF THE INVENTION

It would be advantageous to achieve a buoyant pool lounge chair for providing support for a swimmer in an upright, semi-reclining or sitting position that would improve upon existing limitations in stability and functionality. It would also be desirable to enable a mechanical solution that satisfies comfort while mitigating or eliminating the chances of the buoyant pool lounge chair being overturned in response to shifting of its center or buoyancy. It would be further desirable to enhance convenience. To better address one or more of these concerns, a buoyant pool lounge chair is disclosed.

In one embodiment of the buoyant pool lounge chair for supporting a person while the buoyant pool chair is floating in water, frame members collectively form an open chair frame with buoyant cushions forming a chair seat and a backrest as well as a left arm rest and a right arm rest. The left arm rest and the right arm rest are each intersected by a cup holder. The cup holder includes a recess configured to accept a cup. The recess includes a forward tilt relative to a horizontal axis having an angle between approximately 20 degrees and approximately 40 degrees toward the front end of the buoyant pool lounge chair and away from the rear end of the buoyant pool lounge chair. In operation, when the buoyant pool lounge chair is supporting a person while the buoyant pool chair is floating in water, the forward tilt of the cup holder provides a compensating-leveling mechanism that mitigates spilling of liquid in the cup when the cup is placed within the cup holder. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the present invention.

Figure 1:
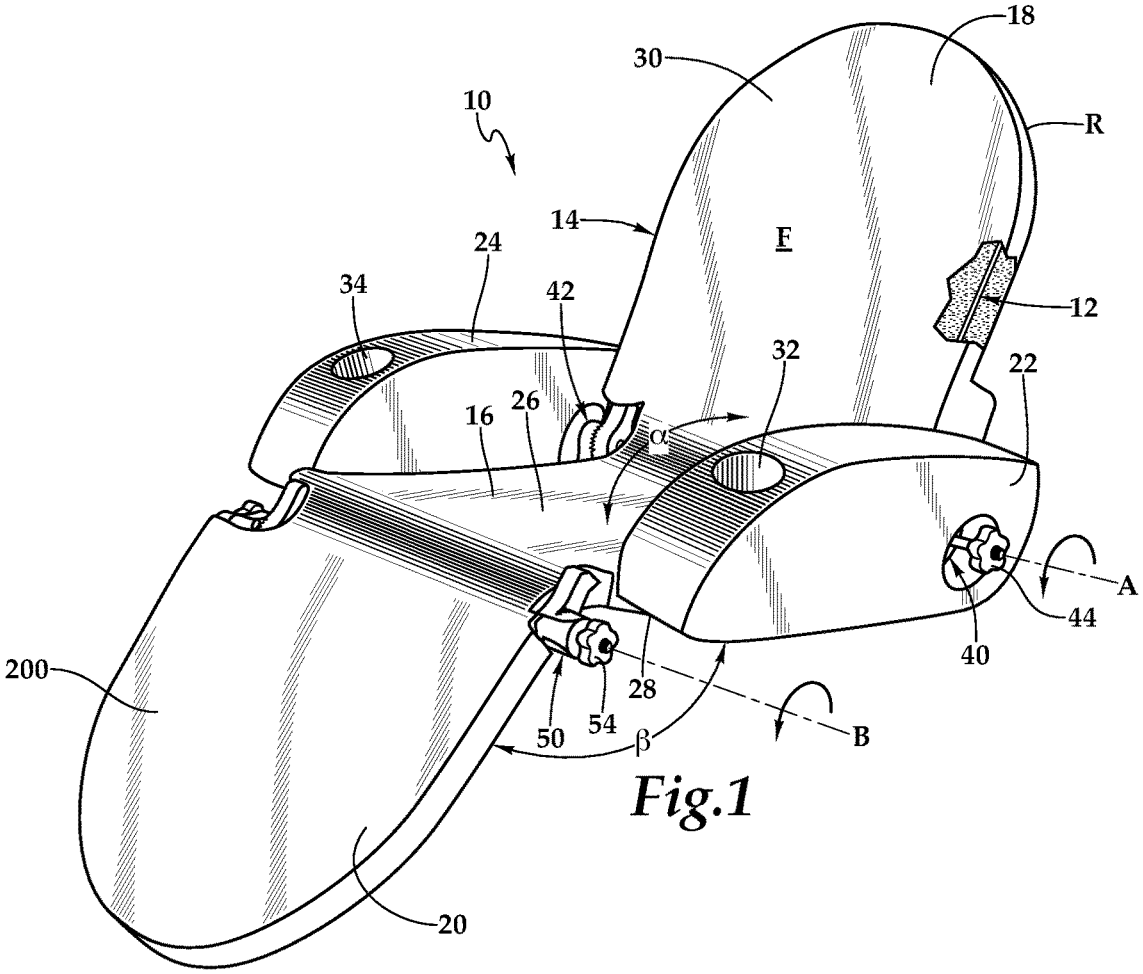
FIG. 1 is a front perspective view of one embodiment of a buoyant pool lounge chair having a buoyant pool lounge chair frame therein, according to the teachings presented herein.
Figure 3:
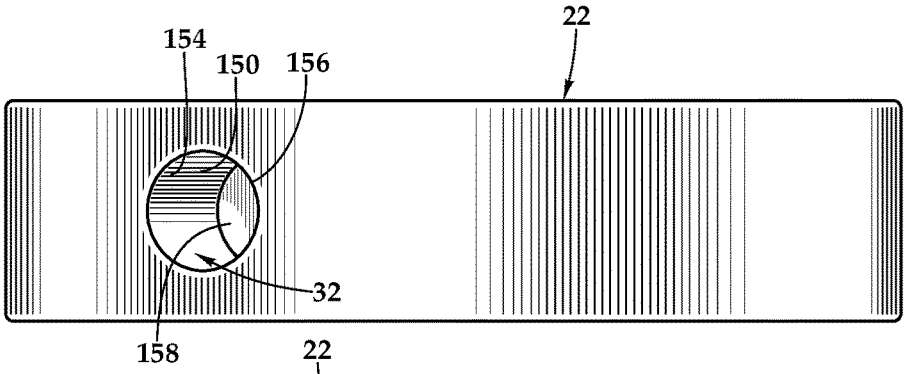
FIG. 3 is a top plan view of a left arm rest which forms a portion of the buoyant pool lounge chair depicted in FIG. 1.
Figure 4:
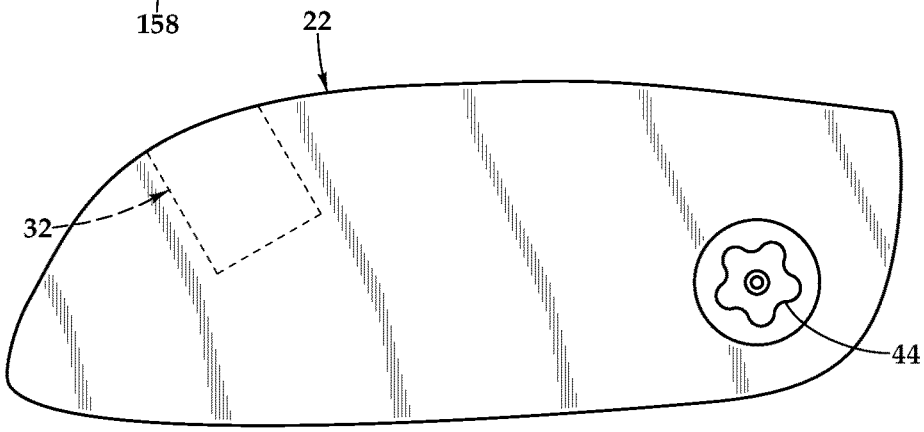
FIG. 4 is a side elevation view of the left arm rest which forms a portion of the buoyant pool lounge chair depicted in FIG. 1.

Referring now to FIG. 1, therein is depicted one embodiment of a buoyant pool lounge chair, which is schematically illustrated and designated 10. As will be discussed in detail hereinbelow, a buoyant pool lounge chair frame 12 is located within the buoyant pool lounge chair 10. As shown, buoyant cushions 14 may be attached to the buoyant pool lounge chair frame 12 such that the buoyant cushions 14 form a chair seat 16, a backrest 18, a leg rest 20, a left arm rest 22, and a right arm rest 24. The chair seat 16 includes a top side 26 and a bottom side 28 as well as a front F and a rear R. A head support cushion 30 may be secured to the chair seat 16. Left and right cup holders 32, 34 may be respectively located in the left arm rest 22 and the right arm rest 24. It should be appreciated, however, that although two cup holders 32, 34 are depicted, in one embodiment of the teachings presented herein, a single cup holder is utilized in the left arm rest 22 or the right arm rest 24.

In one embodiment, rear pivotal coupling and clutch assemblies 40, 42 are coupled to the buoyant pool lounge chair frame 12. As shown, the rear pivotal coupling and clutch assemblies 40, 42 respectively include adjustment knobs 44, 46. By rotation of the adjustment knobs 44, 46 along mutual axis A, each of the pair of the rear pivotal coupling and clutch assemblies 40, 42 permit pivotal movement of the backrest 18 relative to the chair seat 16, and engageable to fix the angle of recline, $\alpha$, of the backrest 18 relative to the chair seat 16. Similarly, in one embodiment, front pivotal coupling and clutch assemblies 50, 52 are coupled to the buoyant pool lounge chair frame 12. As shown, the front pivotal coupling and clutch assemblies 50, 52 respectively include adjustment knobs 54, 56. By rotation of the adjustment knobs 54, 56 along mutual axis B, each of the pair of the front pivotal coupling and clutch assemblies 50, 52 permit pivotal movement of the leg rest 20 relative to the chair seat 16, and engageable to fix the angle of extension, $\beta$, of the leg rest 20 relative to the chair seat 16.

The pair of rear pivotal coupling and clutch assemblies 40, 42 permit pivotal movement of the backrest 18 relative to the chair seat 16 such that the backrest 18 is in proximate contact with the top side 26 of the chair seat 16. The pair of front pivotal coupling and clutch assemblies 50, 52 permit pivotal movement of the leg rest 20 relative to the chair seat 16 such that the leg rest 20 is in proximate contact with the bottom side 28 of the chair seat 16. The pair of rear pivotal coupling and clutch assemblies 40, 42 and the pair of front pivotal coupling and clutch assemblies 50, 52 cooperate in pivotal movement to provide a storage configuration wherein the backrest 18 is in proximate contact with the top side 26 of the chair seat 16 and the leg rest 20 is in proximate contact with the bottom side 28 of the chair seat 16.

In one embodiment, the buoyant pool lounge chair 10 may be relatively light weight for selectively supporting a person in seated, semi-reclining, and fully-reclining lounge positions while the buoyant pool lounge chair 10 is floating in water. As shown, the buoyant pool lounge chair 10 includes a chair seat 16, an adjustable backrest 18, an adjustable leg rest 20, left arm rest 22, and right arm rest 24, which provide full body support in the seated, upright, semi-reclining, and fully reclining lounge positions. The operative upright floating position refers to the flotation orientation of the buoyant pool lounge chair 10 with the adjustable backrest 18 and left and right arm rests 22, 24 generally upright while the chair seat 16 is generally horizontal and at least partially submerged as indicated in FIG. 1. When the buoyant pool lounge chair 10 is floating in water, the occupant is supported in a comfortable lounging orientation with arms being supported by the left and right arm rests 22, 24 and head being supported by the head support cushion 30 on the adjustable backrest 18. The occupant's legs are supported by the adjustable leg rest 20, which projects at varying angles forwardly from the chair seat 16. The adjustable backrest 18 and adjustable leg rest 20 provide for dual hinge adjustable reclining. In the operative upright floating position, the buoyant pool lounge chair 10, including the left and right arm rests 22, 24, tilt back toward the rear R of the buoyant pool lounge chair 10.

Figure 2:
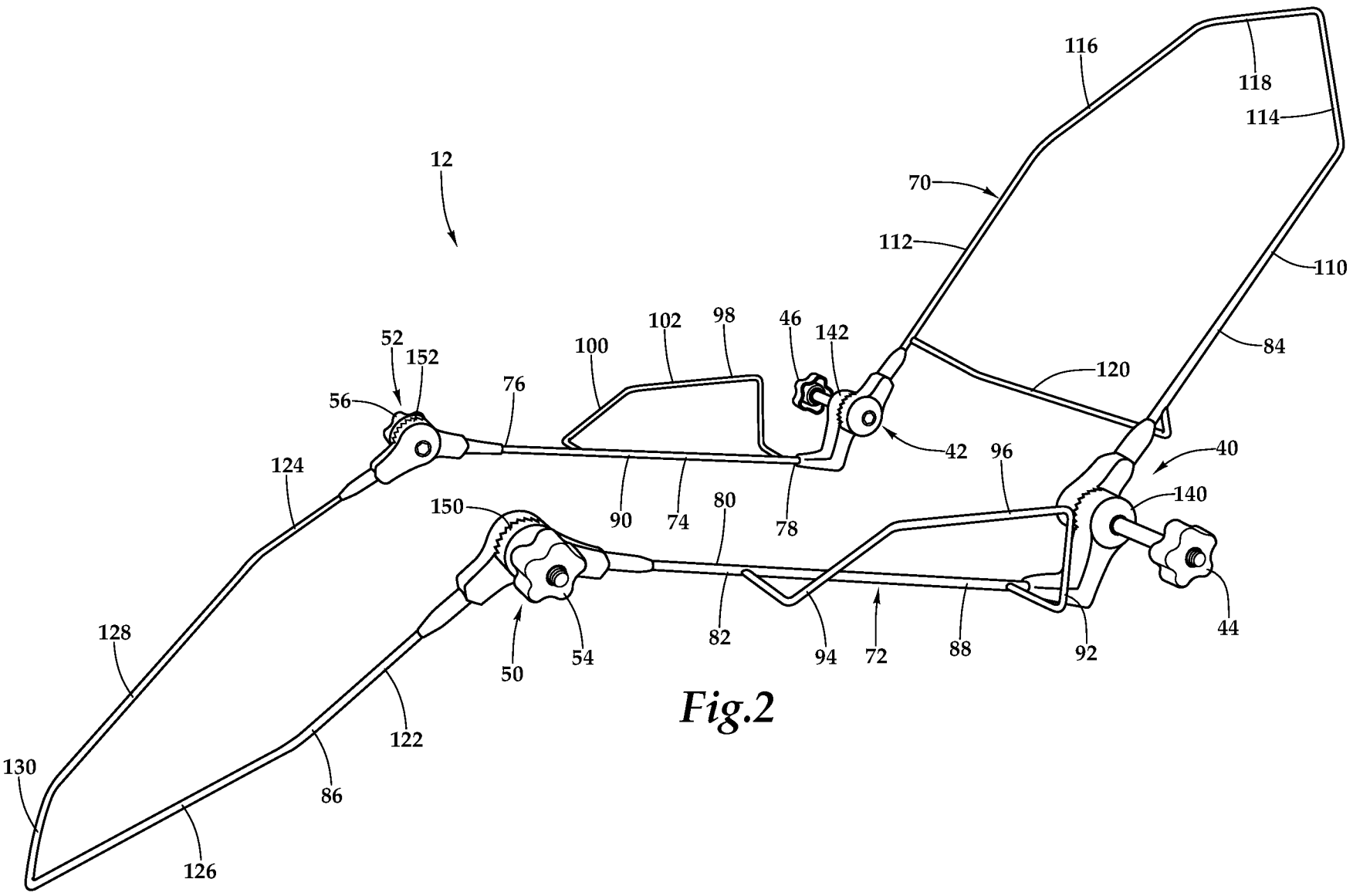
FIG. 2 is a front perspective view of one embodiment of a buoyant pool lounge chair frame according to the teachings presented herein.

Referring now to FIG. 2, therein is depicted one embodiment of the buoyant pool lounge chair with frame 12. Frame members 70 collectively form an open chair frame 72 including a seat frame 74 having a front end 76 and a rear end 78 and a top side 80 and a bottom side 82. A back frame 84 is pivotally coupled to the rear end 78 of the seat frame 74 and a leg frame 86 is pivotally coupled to the front end 76 of the seat frame 74. As shown, the seat frame includes parallel seat support members 88, 90. A left arm frame 92 includes an arm support riser 94 that is laterally offset from the parallel seat support member 88 of the seat frame 74 and an arm rest segment 96 that is vertically offset from the seat frame 74. A right arm frame 98 includes an arm support riser 100 that is laterally offset from the parallel seat support member 90 of the seat frame 74 and an arm rest segment 102 that is vertically offset from the seat frame 74. As previously discussed, the buoyant cushions 14 are attached to the left arm frame 92 and the right arm frame 98 forming the left and right arms rests 22, 24.

In one embodiment, the back frame 84 may include back support members 110, 112 having respective back segments 114, 116 projecting therefrom and intersecting respective ends of a central back segment 118. A back cross member 120 extends from the back support member 110 to the back support member 112. Similarly, in one embodiment, the leg frame 86 may include leg support members 122, 124 having respective leg segments 126, 128 projecting therefrom and intersecting respective ends of a central leg segment 130. A grommet 132 may be attached to the central leg segment 130.

The pair of rear pivotal coupling and clutch assemblies 40, 42 are coupled to the seat frame 74 and to the back frame 84 to permit pivotal movement of the back frame 84 relative to the seat frame 74, and engageable to fix the angle of recline, $\alpha$, of the back frame 84 relative to the seat frame 74. The pair of front pivotal coupling and clutch assemblies 50, 52 are coupled to the leg frame 86 and to the seat frame 74 to permit pivotal movement of the leg frame 86 relative to the seat frame 74, and engageable to fix the angle of extension, $\beta$, of the leg frame 86 relative to the seat frame 74. The pair of rear pivotal coupling and clutch assemblies 40, 42 permit pivotal movement of the back frame 84 relative to the seat frame 74 such that the back frame 84 is in proximate contact with the top side 80 of the seat frame 74. The pair of front pivotal coupling and clutch assemblies 50, 52 permit pivotal movement of the leg frame 86 relative to the seat frame 74 such that the leg frame 86 is in proximate contact with the bottom side 82 of the seat frame 74. The pair of front pivotal coupling and clutch assemblies 50, 52 and the pair of rear pivotal coupling and clutch assemblies 40, 42 cooperate in pivotal movement to provide a storage configuration wherein the back frame 84 is in proximate contact with the top side 80 of the seat frame 74 and the leg frame 86 is in proximate contact with the bottom side 82 of the seat frame 74.

Referring now to FIG. 3 through FIG. 5B, as previously discussed, the chair seat 16 includes an adjustable backrest 18 and adjustable leg rest 20 extending therefrom. The left arm rest 22 and the right arm rest 24 are attached to respective left and right sides of the chair seat 16. As illustrated, with respect to the left arm rest 22 as an example of one embodiment of the structure and function of the left arm rest 22 and the right arm rest 24, the left cup holder 32 intersects the left arm rest 22. The left cup holder 32 includes a recess 150 configured to accept a cup C having a liquid therein. As illustrated, the recess 150 includes a forward tilt 152 to the front F and the front end relative to a horizontal axis H. In one embodiment, the forward tilt 152 may be approximately 30 degrees. As illustrated, the recess 150 includes a sidewall 154 extending from an opening 156 to a heel 158, which supports the bottom of the cup C. The recess 150 may be a circular recess, a squared recess, or another shape. The sidewall 154 may be a buoyant cushion material or include a structurally supported buoyant cushion material, for example. As particularly shown in FIG. 5B, the cup C has the forward tilt to the front F and front end relative to the horizontal axis H like the left cup holder.

Figure 5A:
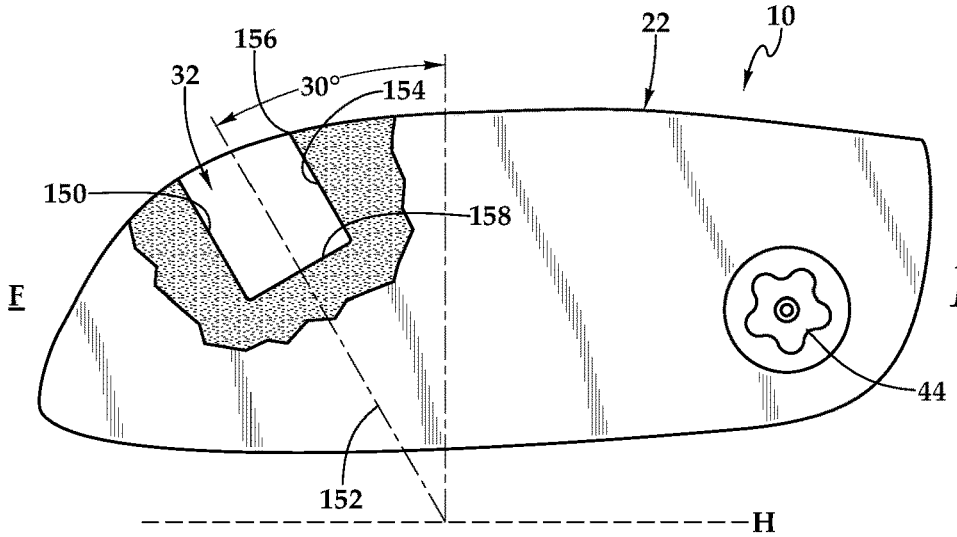
FIG. 5A is a cross-sectional view of the left arm rest which forms a portion of the buoyant pool lounge chair depicted in FIG. 1.
Figure 5B:
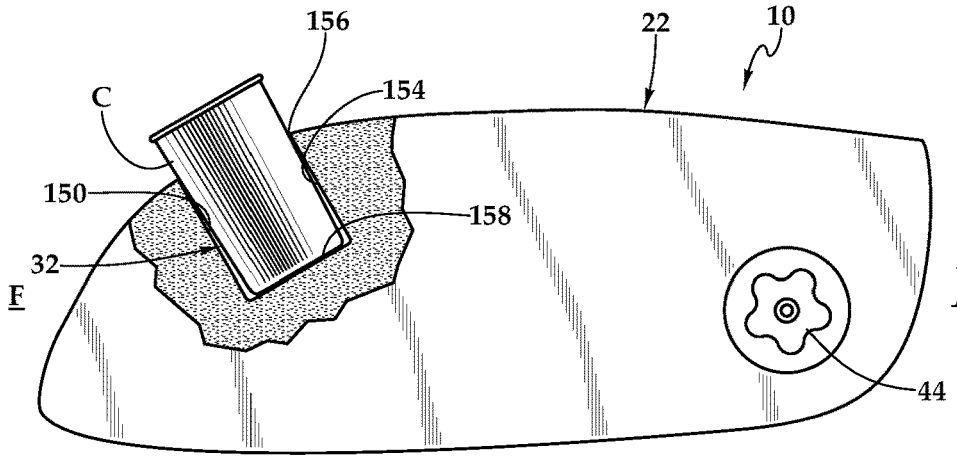
FIG. 5B is a cross-sectional view of the left arm rest depicted in FIG. 5A, wherein a cup is being held in the left arm rest.
Figure 5C:
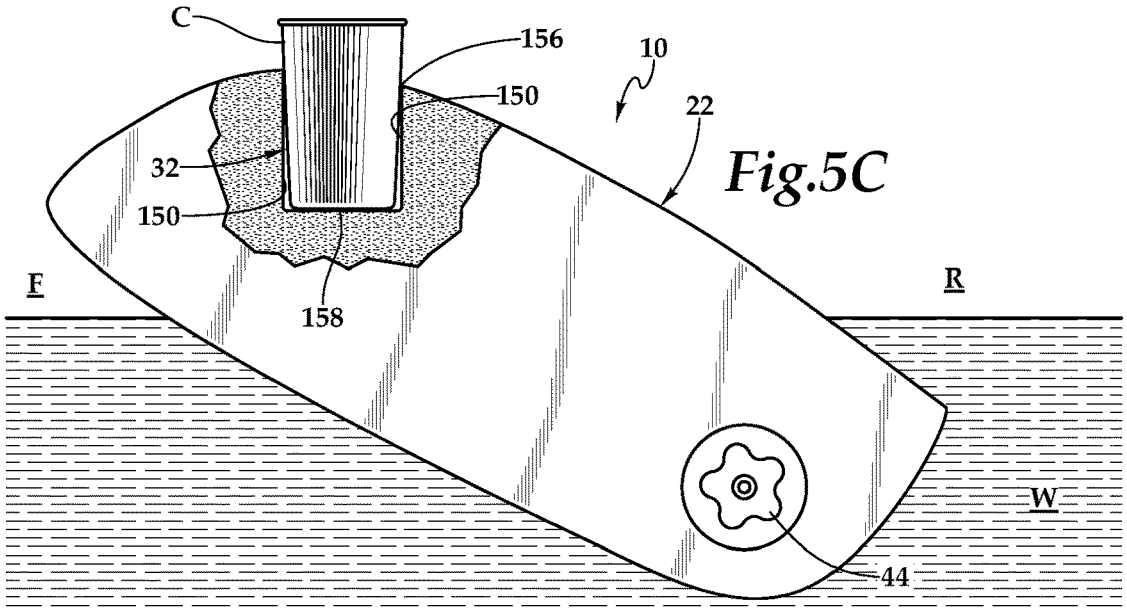
FIG. 5C is a cross-sectional view of the left arm rest depicted in FIG. 5B, wherein the cup is being held in the left arm rest and the buoyant pool lounge is supporting a person while the buoyant pool chair is floating in water.
Figure 6A:
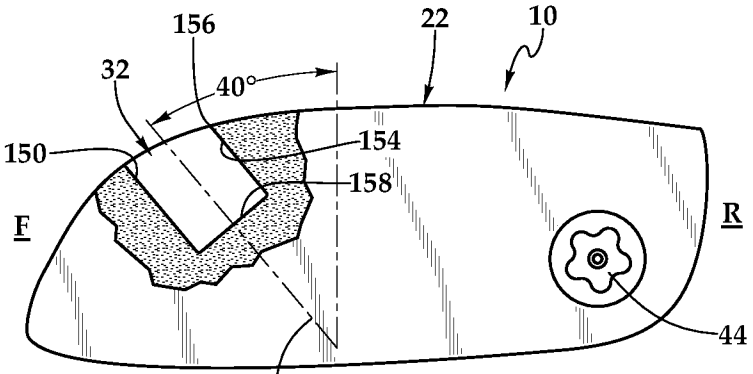
FIG. 6A is a cross-sectional view of some embodiments of a left arm rest which may form a portion of the buoyant pool lounge chair depicted in FIG. 1.
Figure 6B:
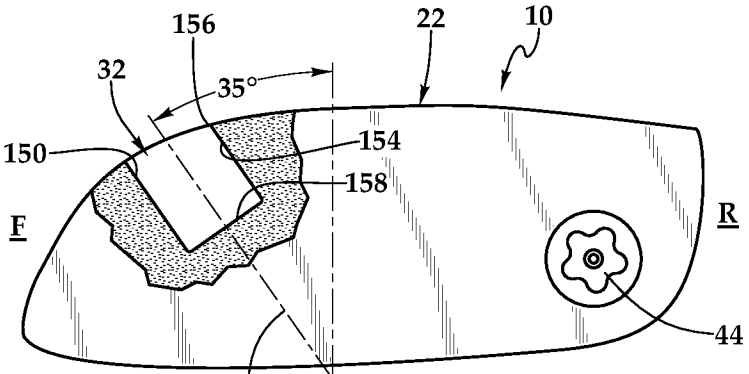
FIG. 6B is a cross-sectional view of some embodiments of a left arm rest which may form a portion of the buoyant pool lounge chair depicted in FIG. 1.
Figure 6C:
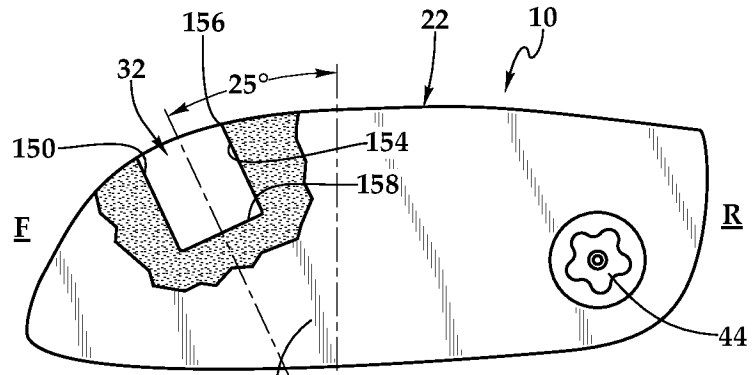
FIG. 6C is a cross-sectional view of some embodiments of a left arm rest which may form a portion of the buoyant pool lounge chair depicted in FIG. 1.
Figure 6D:
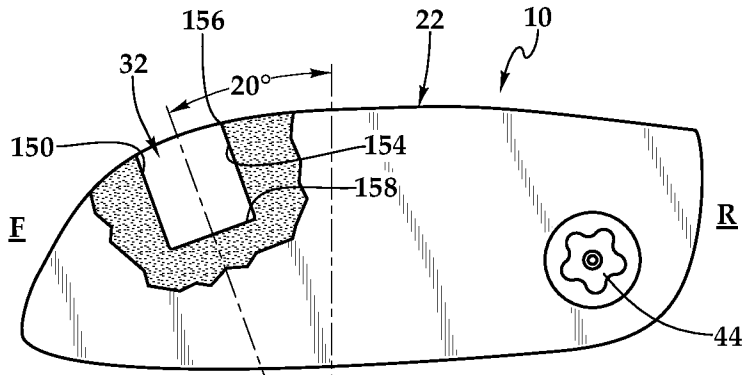
FIG. 6D is a cross-sectional view of some embodiments of a left arm rest which may form a portion of the buoyant pool lounge chair depicted in FIG. 1.

Referring now to FIG. 5C, in one embodiment, in order that the buoyant pool lounge chair 10 provide sufficient buoyancy and maintain a stable upright orientation while the occupant is in a semi-reclining orientation in the water, the buoyant pool lounge chair 10 tilts backward during use, as discussed above. This causes the left cup holder to tilt back as well. In operation, when the buoyant pool lounge chair 10 is supporting a person while the buoyant pool chair 10 is floating in water, the forward tilt 152 of the left cup holder provides a compensating and leveling mechanism that mitigates spilling of liquid in the cup C when the cup C is placed within the cup holder. The forward tilt 152 of the cup holder compensates for the backward tilt of the buoyant pool lounge chair 10 when being used.

Referring now to FIG. 6A through FIG. 6D, the left cup holder 32 intersects the left arm rest 22 and, as previously discussed, the left cup holder 32 includes the recess 150 configured to accept the cup C. The recess 150 includes the forward tilt 152 to the front end, as shown by front F, relative to the horizontal axis. The recess 150 also includes the forward tilt 152 away from the rear end, as shown by rear R, relative to the horizontal axis. In one embodiment, the forward tilt 152 may be an angle between approximately 20 degrees and approximately 40 degrees. In another embodiment, the forward tilt 152 may be an angle between approximately 25 degrees and approximately 35 degrees, as shown by θ25 and θ35. It should be appreciated that the cup holder 32 presented herein may be utilized with a variety of designs and builds of buoyant pool lounge chairs and the particular chair design and build in FIG. 1 and FIG. 2, for example, is for exemplary illustration purposes only. By way of example and not by way of limitation, as illustrated, the buoyant pool lounge chair for supporting a person while the buoyant pool chair is floating in water may include the chair seat having the backrest extending therefrom and the left arm rest and the right arm rest attached to the left and right sides of the chair seat. The cup holder may intersect one of the left arm rest and the right arm rest. As discussed, the cup holder may include the recess configured to accept the cup. The recess may include a forward tilt to the front end with an angle between approximately 20 degrees and approximately 40 degrees.

As constructed, in one embodiment, the buoyant pool lounge chair frame 10 may be designed as a continuous form of pliable foam material of constant or appropriately varying density that varies in thickness to provide the buoyant cushions 14 having a protection coating 200 thereon. The construction may include molded foam being provided by a single molding process, and may include void spaces of select shapes to accommodate the cup holders or various components of the frame members 70, for example. In one embodiment, the construction includes slabs of closed cell polyurethane foam, such as closed cell polyurethane foam F, having a density in the range of approximately 1 lbs/ft3 (16 kg/m3) to approximately 6 lbs/ft3 (96 kg/m3). In one embodiment, any required frame members may be constructed of steel rod segments that are welded together or polyvinyl chloride (PVC) material. In another embodiment, multiple closed-cell PVC boards may be used sandwiched between foam slabs to increase the rigidity of components such as the chair seat 16, left arm rest 22, right arm rest 24, adjustable backrest 18, and adjustable leg rest 20. The protective coating 200, which is water proof, may be applied by various processes, including dipping and spraying, for example. Further, the frame members 70 may be made by a partially or fully blown molded process depending on volumes. It should be appreciated that although a particular construction and materials are presented herein, the construction of the buoyant pool lounge chair 10 and cup holders 32, 34 presented herein may vary according to the particular application and other constructions and choices of materials within the teachings presented herein.

As previously alluded, special care should be taken in the consideration of buoyant lounge chairs to provide sufficient buoyancy material to maintain a stable upright orientation while the occupant is in a semi-reclining orientation following. Such special care is warranted as any buoyant lounge chair can overturn in response to shifting of its center of buoyancy as the occupant turns or moves about. In one embodiment of the buoyant pool lounge chair 10 buoyancy sufficient to support an adult occupant having a body weight of 250 lbs (113 kg) is provided by the construction. Further, special care is warranted as any beverage can be overturned or spilled in response to shifting or even normal use.

The order of execution or performance of the methods and operations illustrated and described herein is not essential, unless otherwise specified. That is, elements of the methods and flows may be performed in any order, unless otherwise specified, and that the methods may include more or less elements than those disclosed herein. For example, it is contemplated that executing or performing a particular step before, contemporaneously with, or after another step are all possible sequences of execution.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A buoyant pool lounge chair for supporting a person while the buoyant pool chair is floating in water, comprising:

frame members collectively forming an open chair frame, the frame members including a seat frame having a front end and a rear end, the seat frame having a top side and a bottom side;

buoyant cushions attached to the frame members, the buoyant cushions forming a chair seat, a backrest, and a leg rest;

a left arm frame including a left arm support riser that is laterally offset from the seat frame and a left arm rest segment that is vertically offset from the seat frame;

a right arm frame including a right arm support riser that is laterally offset from the seat frame and a right arm rest segment that is vertically offset from the seat frame;

buoyant cushions attached to the left arm frame and the left arm frame forming a left arm rest and a left arm rest; and a left cup holder intersecting the left arm rest, the left cup holder including a recess configured to accept a cup, the recess having a forward tilt to the front end relative to a horizontal axis, the forward tilt being an angle between approximately 20 degrees and approximately 40 degrees.

2. The buoyant pool lounge chair as recited in claim 1, wherein the forward tilt further comprises an angle between approximately 25 degrees and approximately 35 degrees.

3. The buoyant pool lounge chair as recited in claim 1, wherein the forward tilt further comprises an angle of approximately 30 degrees.

4. The buoyant pool lounge chair as recited in claim 1, wherein the recess further comprises a circular recess.

5. The buoyant pool lounge chair as recited in claim 1, wherein the recess further comprises a squared recess.

6. The buoyant pool lounge chair as recited in claim 1, wherein the recess of the left cup holder further comprises a sidewall extending from an opening to a heel.

7. The buoyant pool lounge chair as recited in claim 6, wherein the sidewall further comprises a buoyant cushion material.

8. The buoyant pool lounge chair as recited in claim 6, wherein the sidewall further comprises a structurally supported buoyant cushion material.

9. A buoyant pool lounge chair for supporting a person while the buoyant pool chair is floating in water, comprising:

frame members collectively forming an open chair frame, the frame members including a seat frame having a front end and a rear end, the seat frame having a top side and a bottom side;

buoyant cushions attached to the frame members, the buoyant cushions forming a chair seat, a backrest, and a leg rest;

a left arm frame including a left arm support riser that is laterally offset from the seat frame and a left arm rest segment that is vertically offset from the seat frame;

a right arm frame including a right arm support riser that is laterally offset from the seat frame and a right arm rest segment that is vertically offset from the seat frame;

buoyant cushions attached to the right arm frame and the right arm frame forming a right arm rest and a right arm rest; and a right cup holder intersecting the right arm rest, the right cup holder including a recess configured to accept a cup, the recess having a forward tilt to the front end relative to a horizontal axis, the forward tilt being an angle between approximately 20 degrees and approximately 40 degrees.

10. The buoyant pool lounge chair as recited in claim 9, wherein the forward tilt further comprises an angle between approximately 25 degrees and approximately 35 degrees.

11. The buoyant pool lounge chair as recited in claim 9, wherein the forward tilt further comprises an angle of approximately 30 degrees.

12. The buoyant pool lounge chair as recited in claim 9, wherein the recess further comprises a circular recess.

13. The buoyant pool lounge chair as recited in claim 9, wherein the recess further comprises a squared recess.

14. The buoyant pool lounge chair as recited in claim 9, wherein the recess of the right cup holder further comprises a sidewall extending from an opening to a heel.

15. The buoyant pool lounge chair as recited in claim 14, wherein the sidewall further comprises a buoyant cushion material.

16. The buoyant pool lounge chair as recited in claim 14, wherein the sidewall further comprises a structurally supported buoyant cushion material.

17. A buoyant pool lounge chair for supporting a person while the buoyant pool chair is floating in water, comprising:

frame members collectively forming an open chair frame, the frame members including a seat frame having a front end and a rear end, the seat frame having a top side and a bottom side;

buoyant cushions attached to the frame members, the buoyant cushions forming a chair seat, a backrest, and a leg rest;

left and right arm frames including respective left and right arm support risers that are laterally offset from the seat frame and respective left and right arm rest segments that are vertically offset from the seat frame;

buoyant cushions attached to the left and right arm frame and the left and right arm frame forming a left and right arm rest and a left and right arm rest;

a left cup holder intersecting the left arm rest, the left cup holder including a recess configured to accept a cup, the recess having a forward tilt to the front end relative to a horizontal axis; and a right cup holder intersecting the right arm rest, the right cup holder including a recess configured to accept a cup, the recess having the forward tilt to the front end relative to the horizontal axis.

18. The buoyant pool lounge chair as recited in claim 17, wherein the forward tilt further comprises an angle of approximately 30 degrees.

19. The buoyant pool lounge chair as recited in claim 17, wherein the recess further comprises a circular recess.

20. The buoyant pool lounge chair as recited in claim 17, wherein the recess further comprises a squared recess.

* * * * *